US009233528B2

(12) United States Patent
Liu

(10) Patent No.: US 9,233,528 B2
(45) Date of Patent: Jan. 12, 2016

(54) METHODS FOR INK-BASED DIGITAL PRINTING USING IMAGING MEMBER SURFACE CONDITIONING FLUID

(71) Applicant: XEROX CORPORATION, Norwalk, CT (US)

(72) Inventor: Chu-heng Liu, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 21 days.

(21) Appl. No.: 14/139,721

(22) Filed: Dec. 23, 2013

(65) Prior Publication Data

US 2015/0174888 A1 Jun. 25, 2015

(51) Int. Cl.

| | |
|---|---|
| ***B41F 7/24*** | (2006.01) |
| *B41N 3/08* | (2006.01) |
| *B41C 1/10* | (2006.01) |

(52) U.S. Cl.

CPC ... *B41F 7/24* (2013.01); *B41C 1/10* (2013.01); *B41N 3/08* (2013.01)

(58) Field of Classification Search

USPC ..... 101/147

See application file for complete search history.

(56) References Cited

U.S. PATENT DOCUMENTS

| | | | | |
|---|---|---|---|---|
| 2005/0115429 | A1* | 6/2005 | Link | B41C 1/1008 101/463.1 |
| 2012/0103212 | A1 | 5/2012 | Stowe et al. | |
| 2013/0104756 | A1 | 5/2013 | Stowe et al. | |
| 2013/0247788 | A1 | 9/2013 | Liu et al. | |

* cited by examiner

*Primary Examiner* — Daniel J Colilla
*Assistant Examiner* — Quang X Nguyen
(74) *Attorney, Agent, or Firm* — Ronald E. Prass, Jr.; Prass LLP

(57) ABSTRACT

An ink-based digital printing method includes applying conditioning fluid to an imaging member surface wherein the fluid is absorbed by imaging member surface, which includes VITON. Dampening fluid is subsequently applied to the imaging member surface for development by a laser imaging system to form a latent image. Ink is applied to the developed latent image on the imaging member surface to form an ink image that is transferred to paper to form a print that is free of tiger stripe image quality defects.

14 Claims, 3 Drawing Sheets

METHODS FOR INK-BASED DIGITAL PRINTING USING IMAGING MEMBER SURFACE CONDITIONING FLUID

FIELD OF DISCLOSURE

The disclosure relates to ink-based digital printing systems and methods. In particular, the disclosure relates to methods for ink-based digital printing using a conditioning fluid for conditioning a fluoropolymer-elastomer-containing surface layer of an imaging member.

BACKGROUND

Conventional lithographic printing techniques cannot accommodate true high-speed variable data printing processes in which images to be printed change from impression to impression, for example, as enabled by digital printing systems. The lithography process is often relied upon, however, because it provides very high quality printing due to the quality and color gamut of the inks used. Lithographic inks are also less expensive than other inks, toners, and many other types of printing or marking materials.

Ink-based digital printing uses a variable data lithography printing system, or digital offset printing system. A "variable data lithography system" is a system that is configured for lithographic printing using lithographic inks and based on digital image data, which may be variable from one image to the next. "Variable data lithography printing," or "digital ink-based printing," or "digital offset printing" is lithographic printing of variable image data for producing images on a substrate that are changeable with each subsequent rendering of an image on the substrate in an image forming process.

For example, a digital offset printing process may include transferring radiation-curable ink onto a portion of a fluorosilicone-containing imaging member surface that has been selectively coated with a dampening fluid layer according to variable image data. The ink is then cured and transferred from the printing plate to a substrate such as paper, plastic, or metal on which an image is being printed. The same portion of the imaging plate may be cleaned and used to make a succeeding image that is different than the preceding image, based on the variable image data. Ink-based digital printing systems are variable data lithography systems configured for digital lithographic printing that may include an imaging member having a reimageable surface layer, such as a silicone-containing surface layer.

Systems may include a dampening fluid metering system for applying dampening fluid to the reimageable surface layer, and an imaging system for laser-patterning the layer of dampening fluid according to image data. The dampening fluid layer is patterned by the imaging system to form a dampening fluid pattern on a surface of the imaging member based on variable data. The imaging member is then inked to form an ink image based on the dampening fluid pattern. The ink image may be partially cured, and is transferred to a printable medium, and the imaged surface of the imaging member from which the ink image is transferred is cleaned for forming a further image that may be different than the initial image, or based on different image data than the image data used to form the first image. Such systems are disclosed in U.S. patent application Ser. No. 13/095,714 ("714 application"), titled "Variable Data Lithography System," filed on Apr. 27, 2011, by Stowe et al., which is commonly assigned, and the disclosure of which is hereby incorporated by reference herein in its entirety.

In related art offset printing, a combination of a permanently etched imaging plate and a blanket are used to reproduce static images. As discussed above, a digital or variable image print process includes patterning or printing with a dampening fluid or fountain solution, developing with a lithographic-like ink, and almost completely transferring to printable media directly from the imaging member or printing plate. After the image is transferred, any small amount of ink on the printing plate gets cleaned and the plate is prepared for the next printing cycle as described before. The ink-based digital printing plate serves the functions of both an etched imaging plate and a blanket combination as in a related art lithographic print process. These combined functions place demanding and conflicting requirements on the ink-based digital printing plate.

SUMMARY

Related art ink-based digital printing systems use an imaging member having a surface, for example, a blanket or plate, that is formed of materials including fluoropolymer-elastomers such as synthetic rubber sold under the VITON brand, commercially available from DuPont Performance Elastomers L.L.C. While both silicone and fluorosilicone have been found to be useful for ink-based digital printing, VITON and VITON graft or similar materials have been found to exhibit preferred performance and safety as a material useful for forming a surface of an imaging member for ink-based digital printing.

VITON fluoroelastomers are categorized under the ASTM D1418 and ISO 1629 designation of FKM. This class of elastomers is a family comprising copolymers of hexafluoropropylene (HFP) and vinylidene fluoride (VDF or VF2), terpolymers of tetrafluoroethylene (TFE), vinylidene fluoride (VDF) and hexafluoropropylene (HFP) as well as perfluoromethylvinylether (PMVE) containing specialties. The fluorine content of the most common VITON grades varies between 66 and 70%.

Release fluid has been found to be useful for enhancing ink adhesion and release on an imaging member surface during ink-based printing. The release fluid may interfere, however, with other ink-based digital printing process such as laser evaporation in an imaging process, ink-based digital printing fountain solution application, and inking. As such, to reduce or control ink adhesion to the imaging member surface, methods are provided that include applying a conditioning fluid onto an imaging member surface wherein the conditioning fluid is absorbed by the imaging member surface. Methods include applying a thin, uniform layer of dampening fluid onto the imaging member surface having the absorbed conditioning fluid. Methods may include developing the dampening fluid layer to form a latent image by exposing the layer to laser radiation. Methods may include inking the developed dampening fluid layer to from an ink image that may be transferred from the imaging member surface to a printable substrate.

Exemplary embodiments are described herein. It is envisioned, however, that any system that incorporates features of systems described herein are encompassed by the scope and spirit of the exemplary embodiments.

DETAILED DESCRIPTION

Figure 1:
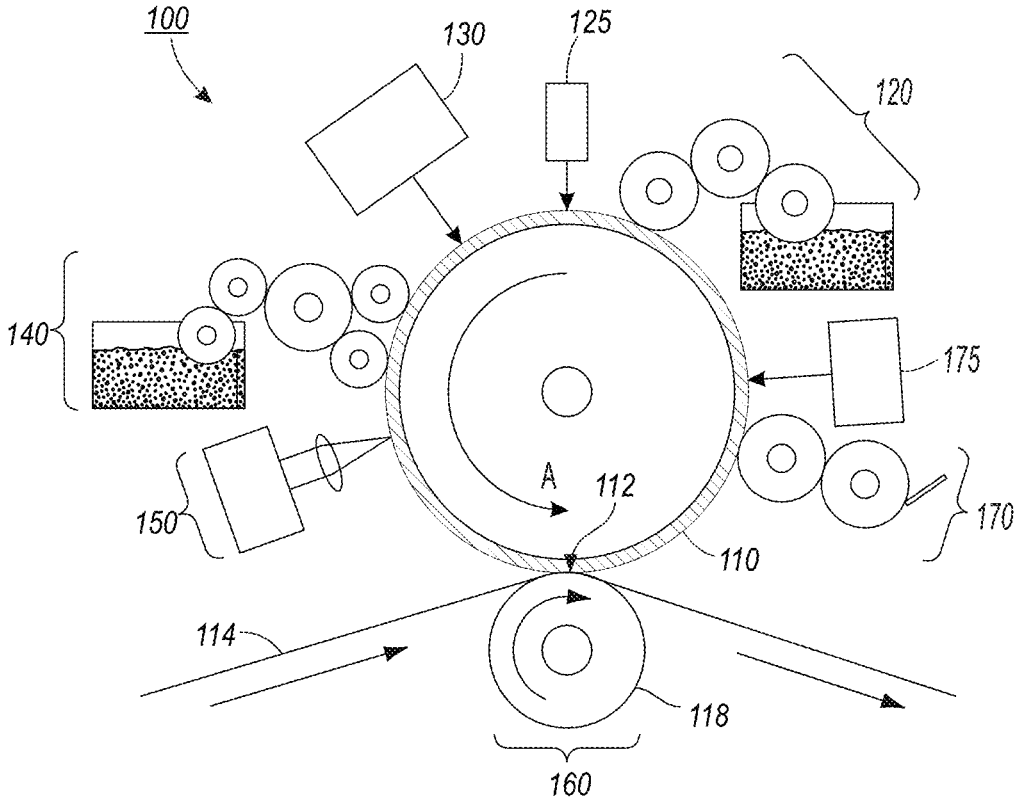
FIG. 1 shows a side diagrammatical view of an art ink-based digital printing system including a conditioning fluid delivery system in accordance with systems of embodiments.

Exemplary embodiments are intended to cover all alternatives, modifications, and equivalents as may be included within the spirit and scope of the apparatus and systems as described herein.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value.

Reference is made to the drawings to accommodate understanding of systems and methods for ink-based digital printing using a conditioning fluid in accordance with embodiments. In the drawings, like reference numerals are used throughout to designate similar or identical elements. The drawings depict various embodiments of illustrative systems for ink-based digital printing with which methods of embodiments may preferably be carried out.

The 714 application describes an exemplary related art variable data lithography system 100 for ink-based digital printing, such as that shown, for example, in FIG. 1. A general description of the exemplary system 100 shown in FIG. 1 is provided here. Additional details regarding individual components and/or subsystems shown in the exemplary system 100 of FIG. 1 may be found in the 714 application.

As shown in FIG. 1, the exemplary system 100 may include an imaging member 110. The imaging member 110 in the embodiment shown in FIG. 1 is a drum, but this exemplary depiction should not be interpreted so as to exclude embodiments wherein the imaging member 110 includes a drum, plate or a belt, or another now known or later developed configuration. The reimageable surface may be formed of materials including, for example, a class of materials commonly referred to as silicones, including polydimethylsiloxane (PDMS), among others. The reimageable surface may be formed of a relatively thin layer over a mounting layer, a thickness of the relatively thin layer being selected to balance printing or marking performance, durability and manufacturability.

The imaging member 110 is used to apply an ink image to an image receiving media substrate 114 at a transfer nip 112. The transfer nip 112 is formed by an impression roller 118, as part of an image transfer mechanism 160, exerting pressure in the direction of the imaging member 110. Image receiving medium substrate 114 should not be considered to be limited to any particular composition such as, for example, paper, plastic, or composite sheet film. The exemplary system 100 may be used for producing images on a wide variety of image receiving media substrates. The 714 application also explains the wide latitude of marking (printing) materials that may be used, including marking materials with pigment densities greater than 10% by weight. As does the 714 application, this disclosure will use the term ink to refer to a broad range of printing or marking materials to include those which are commonly understood to be inks, pigments, and other materials which may be applied by the exemplary system 100 to produce an output image on the image receiving media substrate 114.

The 714 application depicts and describes details of the imaging member 110 including the imaging member 110 being comprised of a reimageable surface layer formed over a structural mounting layer that may be, for example, a cylindrical core, or one or more structural layers over a cylindrical core.

The exemplary system 100 includes a dampening fluid system 120 generally comprising a series of rollers, which may be considered as dampening rollers or a dampening unit, for uniformly wetting the reimageable surface of the imaging member 110 with dampening fluid. A purpose of the dampening fluid system 120 is to deliver a layer of dampening fluid, generally having a uniform and controlled thickness, to the reimageable surface of the imaging member 110. As indicated above, it is known that a dampening fluid such as fountain solution may comprise mainly water optionally with small amounts of isopropyl alcohol or ethanol added to reduce surface tension as well as to lower evaporation energy necessary to support subsequent laser patterning, as will be described in greater detail below. Small amounts of certain surfactants may be added to the fountain solution as well. Alternatively, other suitable dampening fluids may be used to enhance the performance of ink based digital lithography systems. Exemplary dampening fluids include water, NOVEC 7600 (1,1,1,2,3,3-Hexafluoro-4-(1,1,2,3,3,3-hexafluoropropoxy)pentane, CAS#870778-34-0.), and D4 (octamethylcyclotetrasiloxane). Other suitable dampening fluids are disclosed, by way of example, in co-pending U.S. patent application Ser. No. 13/284,114, titled "Dampening Fluid For Digital Lithographic Printing," filed on Oct. 28, 2011, by Stowe, the disclosure of which is hereby incorporated herein by reference in its entirety.

Once the dampening fluid is metered onto the reimageable surface of the imaging member 110, a thickness of the dampening fluid may be measured using a sensor 125 that may provide feedback to control the metering of the dampening fluid onto the reimageable surface of the imaging member 110 by the dampening fluid system 120.

After a precise and uniform amount of dampening fluid is provided by the dampening fluid system 120 on the reimageable surface of the imaging member 110, and optical patterning subsystem 130 may be used to selectively form a latent image in the uniform dampening fluid layer by image-wise patterning the dampening fluid layer using, for example, laser energy. Typically, the dampening fluid will not absorb the optical energy (IR or visible) efficiently. The reimageable surface of the imaging member 110 should ideally absorb most of the laser energy (visible or invisible such as IR) emitted from the optical patterning subsystem 130 close to the surface to minimize energy wasted in heating the dampening fluid and to minimize lateral spreading of heat in order to maintain a high spatial resolution capability. Alternatively, an appropriate radiation sensitive component may be added to the dampening fluid to aid in the absorption of the incident radiant laser energy. While the optical patterning subsystem 130 is described above as being a laser emitter, it should be understood that a variety of different systems may be used to deliver the optical energy to pattern the dampening fluid.

The mechanics at work in the patterning process undertaken by the optical patterning subsystem 130 of the exemplary system 100 are described in detail with reference to FIG. 5 in the 714 application. Briefly, the application of optical patterning energy from the optical patterning subsystem 130 results in selective removal of portions of the layer of dampening fluid.

Following patterning of the dampening fluid layer by the optical patterning subsystem 130, the patterned layer over the reimageable surface of the imaging member 110 is presented to an inker subsystem 140. The inker subsystem 140 is used to apply a uniform layer of ink over the layer of dampening fluid and the reimageable surface layer of the imaging member 110. The inker subsystem 140 may use an anilox roller to meter an offset lithographic ink onto one or more ink forming rollers that are in contact with the reimageable surface layer of the imaging member 110. Separately, the inker subsystem 140 may include other traditional elements such as a series of metering rollers to provide a precise feed rate of ink to the reimageable surface. The inker subsystem 140 may deposit the ink to the pockets representing the imaged portions of the reimageable surface, while ink on the unformatted portions of the dampening fluid will not adhere to those portions.

The cohesiveness and viscosity of the ink residing in the reimageable layer of the imaging member 110 may be modified by a number of mechanisms. One such mechanism may involve the use of a rheology (complex viscoelastic modulus) control subsystem 150. The rheology control system 150 may form a partial crosslinking core of the ink on the reimageable surface to, for example, increase ink cohesive strength relative to the reimageable surface layer. Curing mechanisms may include optical or photo curing, heat curing, drying, or various forms of chemical curing. Cooling may be used to modify rheology as well via multiple physical cooling mechanisms, as well as via chemical cooling.

The ink is then transferred from the reimageable surface of the imaging member 110 to a substrate of image receiving medium 114 using a transfer subsystem 160. The transfer occurs as the substrate 114 is passed through a nip 112 between the imaging member 110 and an impression roller 118 such that the ink within the voids of the reimageable surface of the imaging member 110 is brought into physical contact with the substrate 114. With the adhesion of the ink having been modified by the rheology control system 150, modified adhesion of the ink causes the ink to adhere to the substrate 114 and to separate from the reimageable surface of the imaging member 110. Careful control of the temperature and pressure conditions at the transfer nip 112 may allow transfer efficiencies for the ink from the reimageable surface of the imaging member 110 to the substrate 114 to exceed 95%. While it is possible that some dampening fluid may also wet substrate 114, the volume of such a dampening fluid will be minimal, and will rapidly evaporate or be absorbed by the substrate 114.

In certain offset lithographic systems, it should be recognized that an offset roller, not shown in FIG. 1, may first receive the ink image pattern and then transfer the ink image pattern to a substrate according to a known indirect transfer method.

Following the transfer of the majority of the ink to the substrate 114, any residual ink and/or residual dampening fluid must be removed from the reimageable surface of the imaging member 110, preferably without scraping or wearing that surface. An air knife may be employed to remove residual dampening fluid. It is anticipated, however, that some amount of ink residue may remain. Removal of such remaining ink residue may be accomplished through use of some form of cleaning subsystem 170. The 714 application describes details of such a cleaning subsystem 170 including at least a first cleaning member such as a sticky or tacky member in physical contact with the reimageable surface of the imaging member 110, the sticky or tacky member removing residual ink and any remaining small amounts of surfactant compounds from the dampening fluid of the reimageable surface of the imaging member 110. The sticky or tacky member may then be brought into contact with a smooth roller to which residual ink may be transferred from the sticky or tacky member, the ink being subsequently stripped from the smooth roller by, for example, a doctor blade.

The 714 application details other mechanisms by which cleaning of the reimageable surface of the imaging member 110 may be facilitated. Regardless of the cleaning mechanism, however, cleaning of the residual ink and dampening fluid from the reimageable surface of the imaging member 110 is essential to preventing ghosting in the proposed system. Once cleaned, the reimageable surface of the imaging member 110 is again presented to the dampening fluid system 120 by which a fresh layer of dampening fluid is supplied to the reimageable surface of the imaging member 110, and the process is repeated.

In an alternative embodiment, the dampening fluid system 120 may be a dampening fluid vapor application that applies dampening fluid by condensation in digital architecture lithographic printing systems and systems for doing the same. Exemplary systems are disclosed in U.S. patent application Ser. No. 13/426,262, titled "Dampening Fluid Deposition By Condensation In A Digital Lithographic System," filed on Mar. 21, 2012, by Liu et al., the disclosure of which is hereby incorporated by reference herein in its entirety. The dampening fluid may be applied to the surface 211 of the imaging member in a uniform layer of less than 0.5 micron or preferably about 0.1 micron, for example.

FIG. 1 shows a conditioning fluid delivery system 175. The conditioning fluid delivery system 175 may be configured for applying conditioning fluid in accordance with embodiments to the imaging member surface. Upon application, the conditioning fluid is absorbed by the imaging member surface material. The conditioning fluid delivery system 175 is arranged with respect to the central imaging member 110 so that conditioning fluid is applied to a portion of the imaging member 110 surface before the portion is transported to the dampening fluid delivery system 120 during an ink-based digital printing process. After conditioning fluid is applied to the imaging member surface and is absorbed by the imaging member surface, the dampening fluid layer may be applied to the imaging member 110 surface by the dampening fluid delivery system 120.

Suitable materials for use as an imaging member or offset member surface include fluoroelastomers such as VITON, fluorosilicone, and silicone-containing materials. Surface material such as fluorosilicone presents the potential for toxic emission resulting from high temperature pulse heating during laser imaging and radiation induced emission during a UV pre-cure step during a printing process. Further, the functional life of a fluorosilicone containing imaging member surface has been found to be limited. VITON and VITON-graft-containing materials are suitable alternatives to fluorosilicone because they are environmentally safer and are believed to promote a long functional life of imaging member surfaces.

Figure 2:
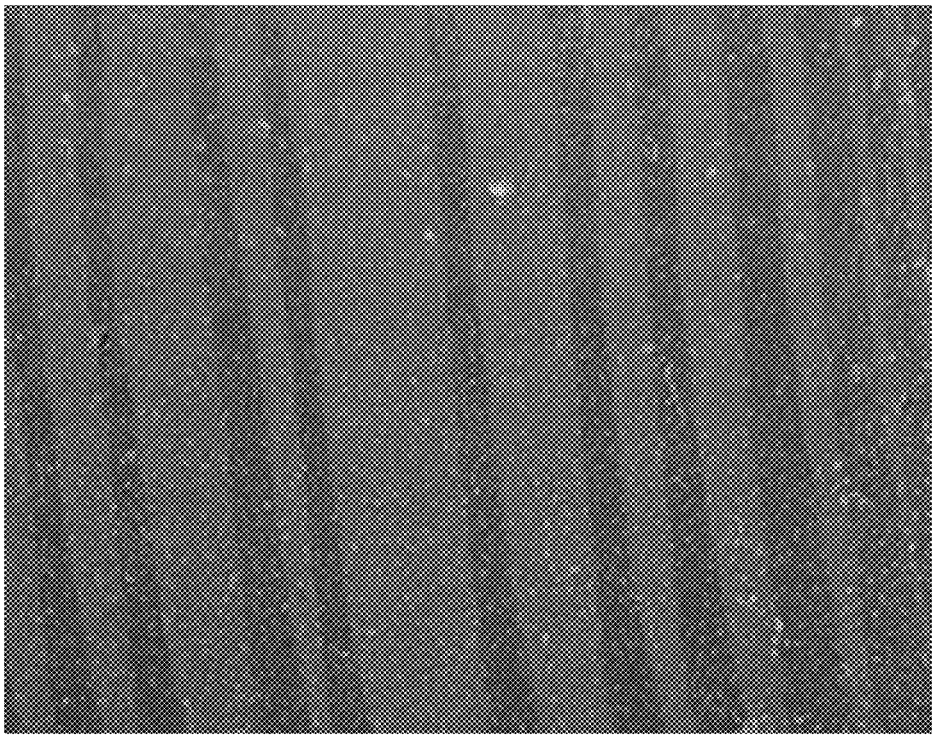
FIG. 2 (RELATED ART)
FIG. 2 shows image quality defects that arise in related art systems.

VITON has been found to cause image quality defects, however, during ink transfer from an imaging member to a substrate. In particular, streaks or "tiger stripes" have been found to be repeatable artifacts present in printed images using related art systems. The stripes may be perpendicular to the process direction, and arise as a result of certain portions of the VITON imaging member surface releasing more ink than other portions of the surface. An example of "tiger stripe" image quality defects is shown in FIG. 2.

Release fluid may be used to reduce adhesion and enhance release. Release fluid resides on the surface of the imaging member has been found to interfere with ink-based digital printing fountain solution application onto an imaging member surface, and to disrupt the laser evaporation and inking processes. Methods of embodiments include using hydrofluoroether liquids such as NOVEC 7600, 7500, for example, as an embedded conditioning fluid for fluoropolymer-containing image member surfaces, such as VITON-containing surfaces, for example. Conditioning fluid in accordance with embodiments reduces ink-VITON surface adhesion, improves ink transfer efficiency, and minimizes or eliminates "tiger stripe" image quality defects. NOVEC series of fluids such as NOVEC 7600, 7500 are fluorocarbon fluids that are compatible with VITON. It has been found that VITON absorbs a significant amount of NOVEC solution by swelling. Once swollen, the surface adhesion to ink is reduced.

In addition to NOVEC fluids, other similar hydrofluoroether liquids materials with high molecular weight are suitable and even preferred for use with methods and systems in accordance with embodiments. Because conditioning fluid in accordance with embodiments may be completely embedded in or absorbed by the plate material, the use of conditioning fluid in accordance with embodiments does not affect dampening fluid or fountain solution application for imaging, and has little impact on inking.

EXAMPLE

In accordance with methods of embodiments, Novec 7500 was applied to the center portion of a VITON sample material, which absorbed the fountain solution. A suitable ink was then applied to the VITON plate. The ink was then transferred to a LustroGloss paper sheet. The area of VITON material that absorbed the conditioning fluid released the ink uniformly, while the untreated portion produced "tiger stripes."

The improved release performance can last for quite some time (>5 min, for example) with one treatment. In methods in accordance with embodiments, a small amount of the release fluid may be continuously applied to the imaging member surface.

Figure 3:
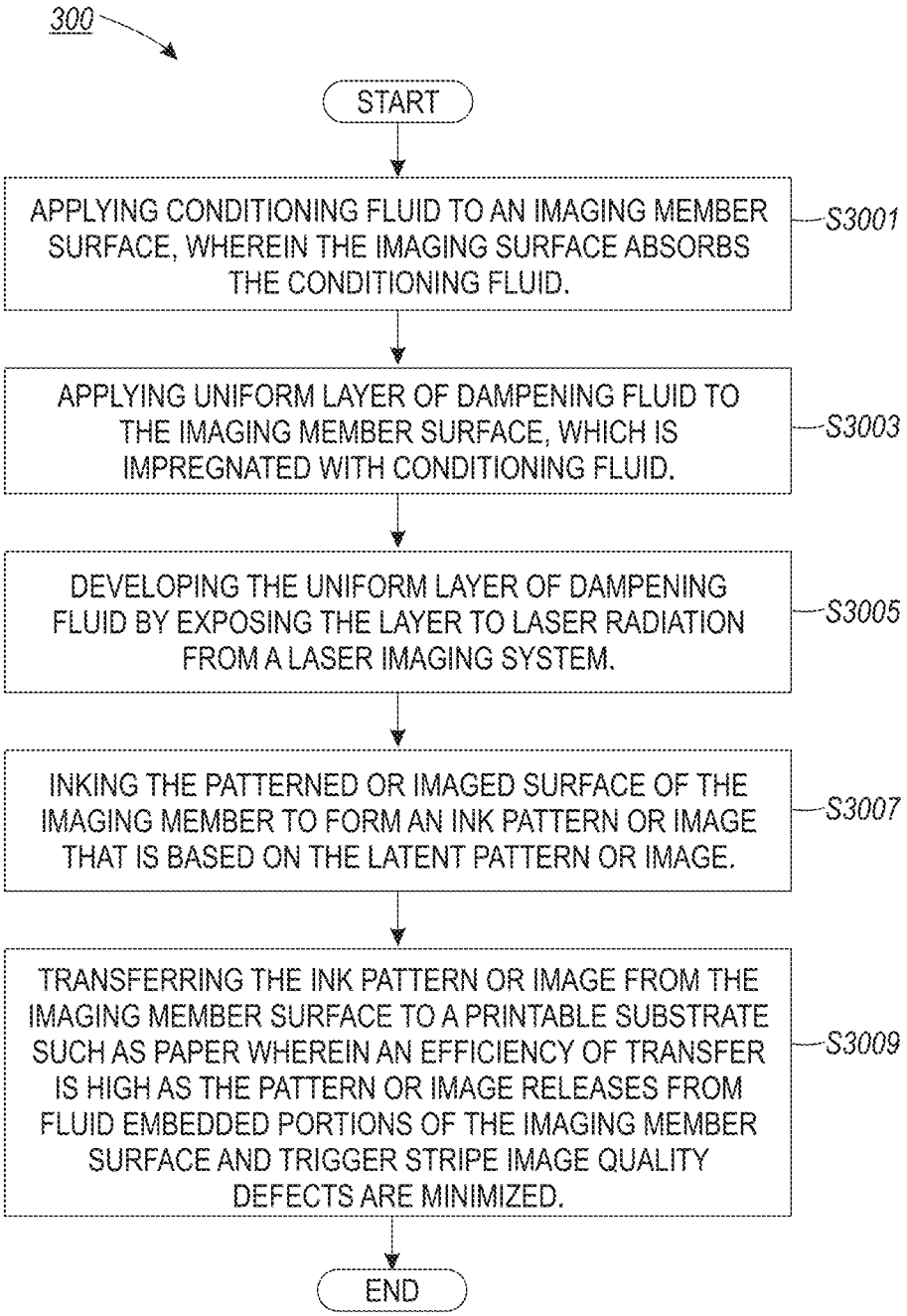
FIG. 3 shows methods for ink-based digital printing using a conditioning fluid in accordance with an exemplary embodiment.

FIG. 3 shows methods in accordance with embodiments. In particular, FIG. 3 shows methods 300 for ink-based digital printing comprising applying a conditioning fluid comprising hydrofluoroether liquids such as NOVEC 7600, 7500 at S300. The imaging member surface formed, for example, of VITON absorbs the conditioning fluid. The fluid may be applied using vapor condensation, a roller system, jetted using an inkjet system, or applied onto a surface of an imaging member using other now known or later developed methods suitable for applying fluid onto an imaging member surface of an ink-based digital printing system.

Method 300 includes applying uniform layer of dampening fluid to the imaging member surface that is impregnated with conditioning fluid at S3003. The conditioning fluid applied at S3001 is absorbed by the imaging member surface before the dampening fluid is applied to the imaging member surface at S3003.

Method 300 includes developing the uniform layer of dampening fluid applied at S3003 using a laser imager to form a latent image on the imaging member surface at S3005. The dampening fluid latent image formed at S3005 may then be inked at S3007. For example, ink may be applied to the imaging member surface using an anilox roll ink delivery system as shown in FIG. 1 to form an ink image based on the patterned dampening fluid layer latent image on the imaging member surface.

The ink image may be transferred at S3009 from the imaging member surface to a printable substrate such as paper. Use of the conditioning fluid in accordance with embodiments enables high efficiency ink transfer as the ink releases from the embedded portions of the imaging member surface. The resulting print includes minimal or no tiger stripe image quality defects.

It will be appreciated that the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A method for ink-based digital printing system, comprising:

applying a conditioning fluid to an imaging member surface whereby the imaging member surface absorbs the conditioning fluid, the conditioning fluid comprising a hydrofluoroether liquid, the imaging member surface comprising a fluoropolymer elastomer;

applying a uniform layer of dampening fluid to the imaging member surface, the surface being impregnated with the conditioning fluid; and inking the imaging member surface after applying the conditioning fluid.

2. The method claim 1, the imaging member surface comprising hydrofluoroelastomers, and hybrids and blends of silicone and hydrofluoroelastomers.

3. The method of claim 1, comprising:

developing the uniform layer of dampening fluid to form a latent image by exposing the layer to laser radiation from a laser imaging system.

4. The method of claim 1, comprising:

transferring the ink image to a printable substrate.

5. The method of claim 4, the printable substrate comprising paper.

6. The method claim 1, further comprising applying the uniform layer of dampening fluid to the imaging member surface after the conditioning fluid applied to the imaging member surface is absorbed by the imaging member surface.

7. A method for ink-based digital printing system, comprising:

applying a conditioning fluid to an imaging member surface whereby the imaging member surface absorbs the conditioning fluid, the conditioning fluid comprising a hydrofluoroether liquid: and applying a uniform layer of dampening fluid to the imagining member surface, the surface being impregnated with the conditioning fluid; and inking the imaging member surface after applying the conditioning fluid.

8. The method of claim 7, the imaging member surface comprising a fluoropolymer elastomer.

9. The method claim 7, the imaging member surface comprising hydrofluoroelastomers, and hybrids and blends of silicone and hydrofluoroelastomers.

10. The method of claim 7, comprising:

developing the uniform layer of dampening fluid to form a latent image by exposing the layer to laser radiation from a laser imaging system.

11. The method of claim 7, comprising:

transferring the ink image to a printable substrate.

12. The method of claim 11, the printable substrate comprising paper.

13. The method of claim 7, the imaging member surface comprising a synthetic rubber.

14. The method claim 7, further comprising applying the uniform layer of dampening fluid to the imaging member surface after the conditioning fluid applied to the imaging member surface is absorbed by the imaging member surface.

* * * * *